US005905450A

United States Patent [19]

Kim et al.

[11] Patent Number: 5,905,450

[45] Date of Patent: May 18, 1999

[54] SYSTEM FOR SUPPORTING FIRE FIGHTING FOR BUILDING AND FIRE FIGHTING METHOD USING THE SAME

[75] Inventors: Dong Hyun Kim; Byung Tae Jang; Jung Sik Kim; Soo Ile Park; Ju Wan Kim; Hae Dong Kim, all of Daejeon, Rep. of Korea

[73] Assignee: Electronics and Telecommunciations Research Institute, Daejeon, Rep. of Korea

[21] Appl. No.: 09/007,819

[22] Filed: Jan. 15, 1998

[30] Foreign Application Priority Data

May 29, 1997 [KR] Rep. of Korea ..... 97-21768

[51] Int. Cl.[6] ..... G08B 23/00

[52] U.S. Cl. ..... 340/967; 340/573; 340/539; 340/825.49; 348/113; 359/13

[58] Field of Search ..... 348/113, 115, 348/116, 143; 359/13, 630; 340/524, 525, 573, 539, 506, 825.06, 691, 825.19, 825.36, 825.49

[56] References Cited

U.S. PATENT DOCUMENTS 5,615,132 3/1997 Horton et al. ..... 340/988 X
5,642,221 6/1997 Fischer et al. ..... 359/477

*Primary Examiner*—Jeffery A. Hofsass
*Assistant Examiner*—Daryl C. Pope
*Attorney, Agent, or Firm*—Antonelli, Terry, Stout & Kraus, LLP

[57] ABSTRACT

A system for supporting a fire fighting for a building and a fire fighting method using the same which are capable of more effectively performing a fire fighting operation by providing, in real time. The system includes a tracker for extracting a moving direction and speed of a fire fighter in a building, a see-through type HMD device for extracting a seeing direction of the fire fighter and providing a current position information of the fire fighter including a graphic and text information to the fire fighter, an externally connected PC for storing an information database corresponding to a structure of a building and information related thereto, tracing a position of the fire fighter in the building based on the moving direction of the fire fighter extracted by the tracker and the information database, judging an additional information with respect to a structure of the interior of the building and the structure which are seen by the fire fighter based on the seeing direction information of the fire fighter extracted by the see-through HMD device and the information database, and transmitting the same to the see-through HMD device, and a wireless data transmitting and receiving apparatus for communicating between the tracker, the see-through HMD device and the externally connected computer.

8 Claims, 4 Drawing Sheets

SYSTEM FOR SUPPORTING FIRE FIGHTING FOR BUILDING AND FIRE FIGHTING METHOD USING THE SAME

BACKGROUND OF THE INVENTION

1. Field of the Invention

The present invention relates to a system for supporting a fire fighting for a building and a fire fighting method using the same, and particularly, to an improved system for supporting a fire fighting for a building and a fire fighting method using the same which are capable of more effectively performing a fire fighting operation by providing, in real time, an additional information such as the structure of a building, which is being monitored by a fire fighter, and the name of a predetermined structure by checking the positions of fire fighters, even when there is not provided any information concerning the structure of the building.

2. Description of the Conventional Art

Generally, if a fire occurs in a building, fire fighters go into the building and conduct a fire fighting operation, a people rescuing operation, etc. If the fire fighter does not know the internal structure of the building or does not have any information concerning the structure of the building, it is very hard to effectively conduct the fire fighting operation. In this case, the fire fighters conduct the operation based on a know-how or a predetermined feeling. Therefore, it is very hard for the fire fighters to effectively conduct the fire fighting operation, etc. due to toxic smoke, hot air, etc.

SUMMARY OF THE INVENTION

Accordingly, it is an object of the present invention to provide a system for supporting a fire fighting for a building and a fire fighting method using the same which overcomes the aforementioned problems encountered in the conventional art.

It is another object of the present invention to provide an improved system for supporting a fire fighting for a building and a fire fighting method using the same which are capable of more effectively performing a fire fighting operation by providing, in real time, an additional information such as the structure of a building, which is being monitored by a fire fighter, and the name of a predetermined structure by checking the positions of fire fighters, even when there is not provided any information concerning the building.

To achieve the above objects, there is provided an improved system for supporting a fire fighting for a building which includes a tracker for extracting a moving direction and speed of a fire fighter in a building, a see-through type head-mounted display (HMD) device for extracting a seeing direction of the fire fighter and providing a current position information of the fire fighter including a graphic and text information to the fire fighter, an externally connected computer (personal computer) for storing an information database corresponding to a structure of a building and information related thereto, tracing a position of the fire fighter in the building based on the moving direction of the fire fighter extracted by the tracker and the information database, judging an additional information with respect to a structure of the interior of the building and the structure which are seen by the fire fighter based on the seeing direction information of the fire fighter extracted by the see-through HMD device and the information database, and transmitting the same to the see-through HMD device, and a wireless data transmitting and receiving apparatus for communicating between the tracker, the see-through HMD device and the externally connected computer.

To achieve the above objects, there is also provided an improved fire fighting method using a system for supporting a fire fighting for a building wherein there are provided a portable device including a transmission and receiving apparatus, a graphic display device, and a tracker device for measuring a current position of a fire fighter, generating a graphic information corresponding to the current position of a fire fighter in the building and displaying the same to the fire fighter, and an externally connected computer for storing an information database corresponding to a structure of the building and information related thereto, judging a position of the fire fighter based on the position information received from the portable device and transmitting the same to the portable device including the graphic information and text information, comprising the steps of a first step for matching an initial start position of a fire fighter with an information of an information database using the portable apparatus before a fire fighter enters the building, a second step in which the portable apparatus recognizes a moving direction and speed of the fire fighter and transmits the thusly recognized information to the externally connected computer in real time when the fire fighter moves, a third step in which traces a position of the fire fighter in the building using the moving speed and direction data and the information database transmitted from the portable apparatus, a fourth step in which the externally connected computer transmits the position information traced in the third step to the portable apparatus and the graphic information and text information are transmitted based on the information database, and a fifth step in which the fire fighter recognizes the position of himself/herself in the building based on the information of the portable apparatus.

Additional advantages, objects and other features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
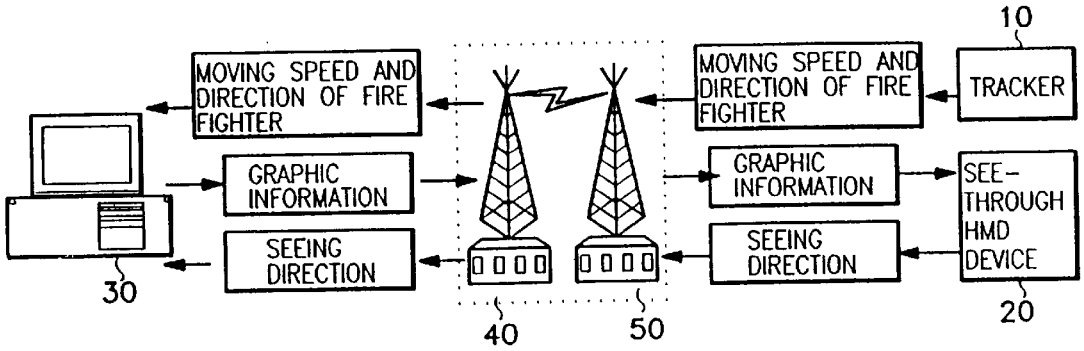
FIG. 1 is a block diagram illustrating a system for supporting a fire fighting according to the present invention.

As shown in FIG. 1, the fire fighting support system according to the present invention includes a tracker 10 for extracting the moving direction of a fire fighter and the moving speed thereof, a see-through head-mounted display (HMD) device 20 for extracting the seeing direction of the fire fighter, generating a graphic and text information, and informing the fire fighters of the current position information of the fire fighters, an externally connected personal computer (PC) 30 for storing the information database concerning the structure of a building and the name thereof, tracing the position of the fire fighters in the building based on the moving information of the fire fighters and the information database extracted by the tracker 10, judging an additional information with respect to the internal structure of the building and the external structure thereof which are being checked by the fire fighters based on the seeing direction information and the information database extracted by the see-through HMD device 20, and transmitting the thusly judged information to the see-through HMD device 20, and wireless data transmitting and receiving apparatuses 40 and 50 for the fire fighter carries the portable device comprised of the tracker 10, the see-through HMD device 20, and the wireless data transmitting and receiving apparatus 50 and moves in the building. The tracker 10 transmits the moving direction and speed of the fire fighters to the externally connected computer 30 using the wireless data transmitting and receiving apparatus 50, and the see-through HMD device 20 extracts the seeing direction of the fire fighter using the direction tracker and transmits the thusly extracted information to the externally connected computer 30 using the wireless data transmitting and receiving apparatus 50.

The externally connected computer 30 receives the moving direction and speed and seeing direction of the fire fighters through the wireless data transmitting and receiving apparatus 40, and computes the position of the fire fighter using the moving direction and speed of the fire fighter. In addition, the additional information (for example, the shape of the interior of the building, the names of major elements, etc) concerning the internal structure of the building and the structures thereof which are checked by the fire fighter are displayed on the see-through HMD device 20 through the wireless data transmitting and receiving apparatuses 40 and 50 by using the seeing direction of the fire fighter.

At this time, the data displayed on the see-through HMD device 20 of the fire fighter is comprised of the spacial information of a CAD data and an attribute data (a text data). The spacial data is a graphic data such as a line, etc. which indicates the shape of the building and the attribute data is an information which may be expressed by a text like the name of an element.

These data each have a predetermined identifier and are interconnected by such identifiers.

The method for displaying the above-described information on the see-through type HMD device 20 of the fire fighter will now be explained.

First, the position information of the fire fighter detected by the tracker and the seeing direction information of the fire fighter extracted by the see-through HMD device are converted into the information of the graphic coordinates by the externally connected computer 30, and the internal of the building is modelled in three dimension using the thusly converted information. The modelled data are displayed on the see-through HMD device using the wireless data transmitting and receiving apparatuses 40 and 50.

At this time, as the tracker device for tracing the position of a predetermined object in the building, a gyroscope which is capable of detecting the moving direction and speed of the object is preferably used.

Figure 2:
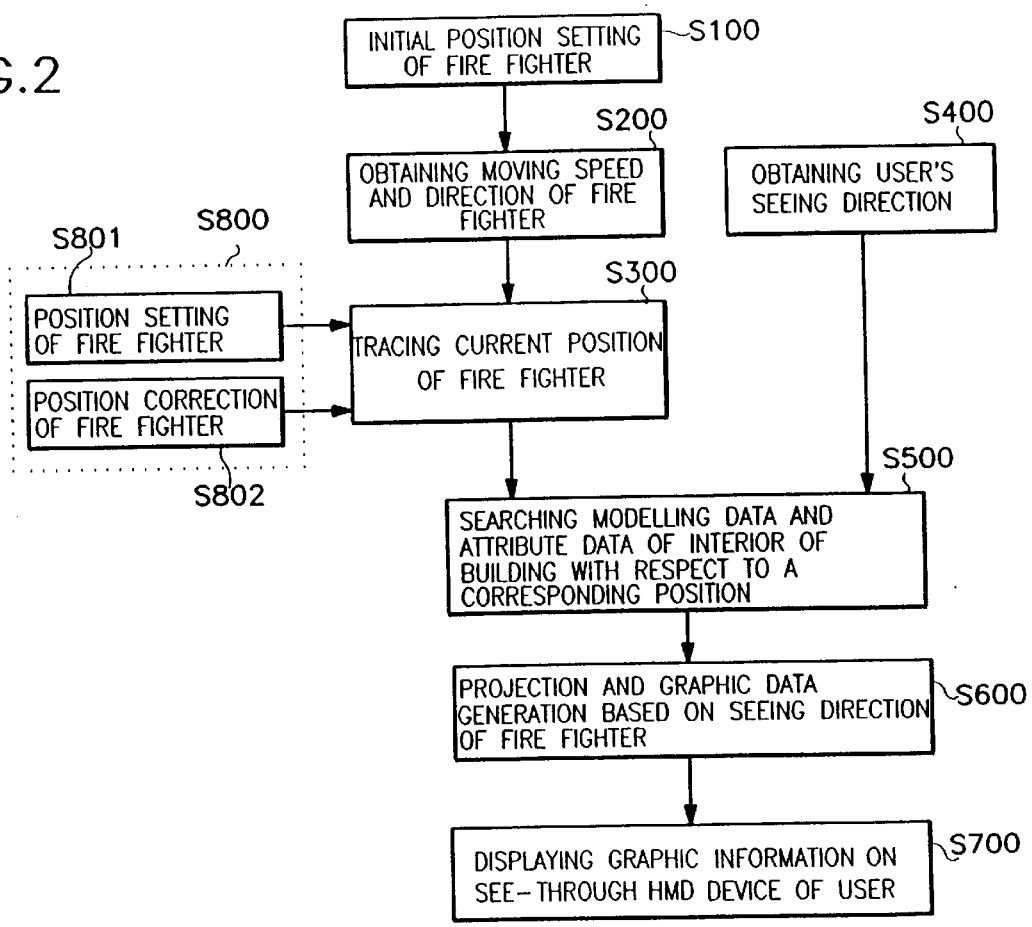
FIG. 2 is a flow chart illustrating a fire fighting method using a system for supporting a fire fighting according to the present invention.

With reference to FIG. 2, the processing flow of the fire fighting support system will now be explained.

First, the processing method of the first fighting support system according to the present invention comprises the steps of a step S100 in which an initial start position of a fire fighter is matched with an information database from the externally connected computer 30 using the portable device equipped with the gyroscope before the fire fighter enters the building, a step S200 in which the portable apparatus recognizes the moving direction and speed of the fire fighter when the fire fighter moves, and the values corresponding to the thusly recognized moving direction and speed are transmitted to the externally connected computer 30, a step S300 in which the externally connected computer 30 traces the position of the fire fighter in the building by using the values corresponding to the moving direction and speed of the fire fighter from the portable device in Step S200 and the information database, a step S400 in which the seeing direction of the fire fighter is obtained, a step S500 in which the externally connected computer 30 transmits the position information traced in the step S300 to the portable device and the modelling data and attribute data corresponding to the interior of the building with respect to a corresponding position is searched, a step S600 in which the projection and graphic data is generated based on the seeing direction of the fire fighter, and a step S700 in which the graphic information is displayed on the see-through HMD device carried by the fire fighter.

The fire fighter who receives the information using the portable device can recognize his/her position in the building. At this time, the portable device is capable of displaying the moving direction and speed more than 20 times per second and transmitting the same to the externally connected computer 30. The externally connected computer 30 traces the position of the fire fighter using the thusly received values.

In addition, in the step S300 in which the position of the fire fighter in the building is traced, there may be a predetermined error. In the present invention, since the data corresponding to the moving direction and speed of the fire fighter from the gyroscope are accumulatively stored, and then the position of the fire fighter is traced using the same, the more the movement of the fire fighter, the more the error.

Therefore, in order to reduce the above-described error, a synchronizing step S800 is performed so that the current position value is matched with the previously stored information value of the building stored in the information database when the fire fighter arrives at a predetermined position (for example, a step, a door, etc,. which may be easily recognized) . In more detail, the synchronizing step S800 is performed by the following method. First, the tracker 10 of the portable device of the fire fighter is turned off, and then the tracker 10 is turned on when the position of himself/herself is matched with the graphic information displayed on the graphic display apparatus by moving the current position of himself/herself in the forward/backward/leftward/rightward directions.

Namely, in a step S801, the position of the fire fighter is set at a predetermined position in the interior of the building, and then the position of the fire fighter is corrected in a step S802.

Figure 3:
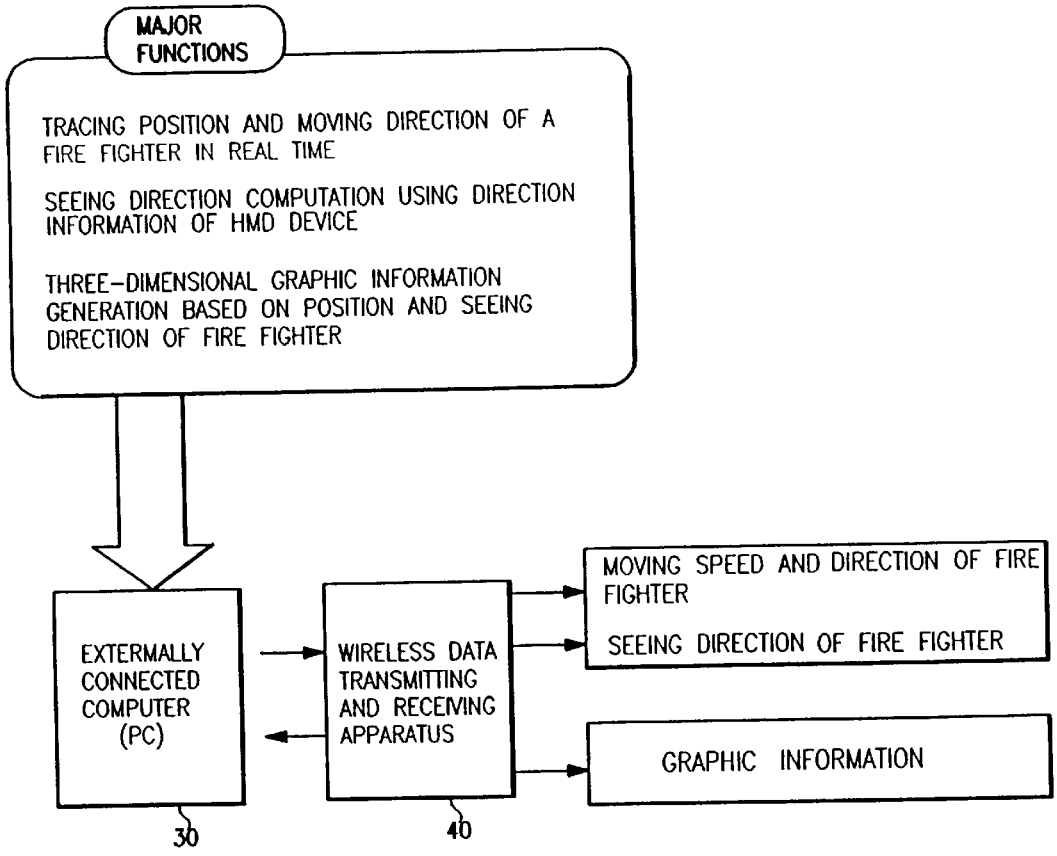
FIG. 3 is a block diagram illustrating a major function of an externally connected personal computer (PC) according to the present invention.

As shown in FIG. 3, the externally connected computer 30 receives the information corresponding to the moving direction, speed and seeing direction of the fire fighter through the wireless data transmitting and receiving apparatus 40, and transmits a graphic information. Here, the externally connected computer 30 traces the current position and moving direction of the fire fighter based on the moving speed and direction information of the fire fighter, receives the seeing direction information of the fire fighter, computes the seeing direction of the fire fighter, generates the three-dimensional graphic information based on the current position and seeing direction of the fire fighter, and transmits the same to the fire fighter.

Figure 4:
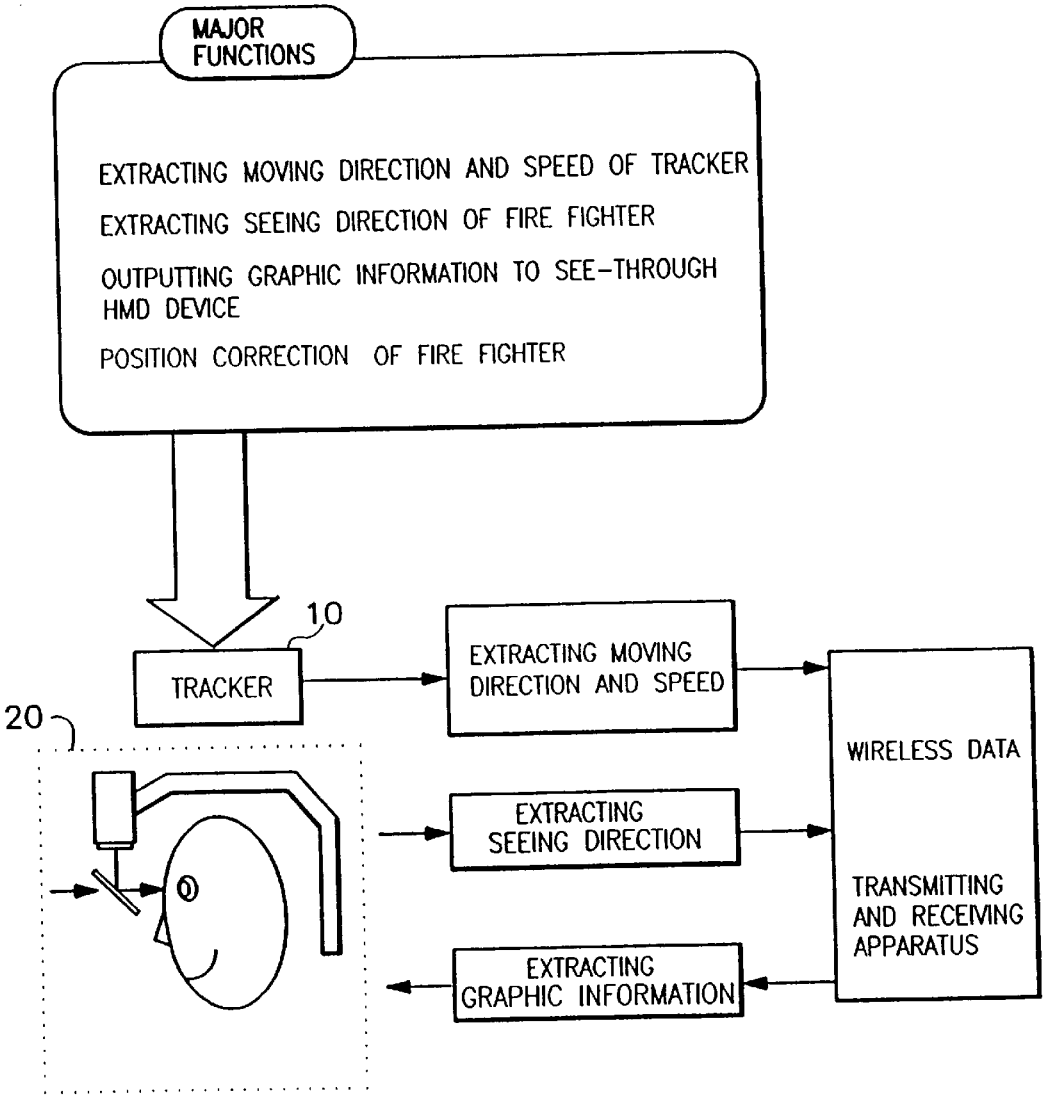
FIG. 4 is a block diagram illustrating a major function of a portable apparatus according to the present invention.

FIG. 4 is a block diagram illustrating a major function of a portable apparatus according to the present invention. As shown therein, the portable device comprised of the tracker 10, the see-through HMD device 20 and the wireless data transmitting and receiving apparatus 50 extracts the moving direction and speed of the fire fighter of the tracker 10, the seeing direction of the fire fighter, outputs a graphic information to the see-through HMD device, and corrects the position of the fire fighter. The tracker 10 extracts the moving direction and speed of the fire fighter and transmits the same to the wireless data transmitting and receiving apparatus 50, and the see-through HMD device 20 extracts the information corresponding to the seeing direction of the fire fighter, and transmits the extracted information to the wireless data transmitting and receiving apparatus 50.

In addition, the wireless data transmitting and receiving apparatus 50 transmits the graphic information received from the wireless data transmitting and receiving apparatus to the see-through HMD device 20.

Figure 5A:
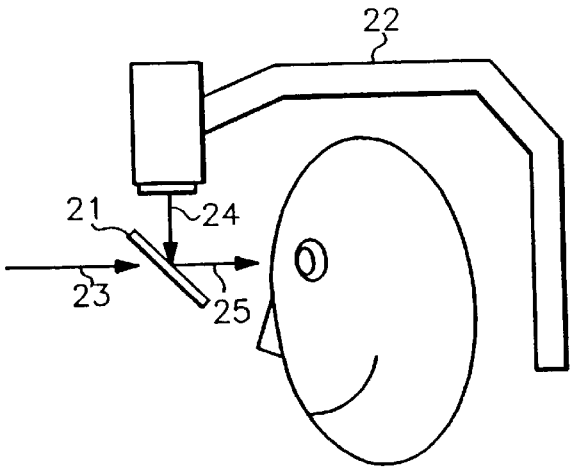
FIG. 5A is a view illustrating the construction of a see-through type head-mounted display (HMD) device according to the present invention.

FIG. 5A is a view illustrating the construction of a see-through type head-mounted display (HMD) device according to the present invention. As shown therein, the see-through HMD device 20 includes an image transmission cable 22 for transmitting a virtual image generated by the externally connected computer 30, and a see-through display device 21 for duplicating the actual information 23 and the virtual image 24. The fire fighter sees an image 25, which is generated by the virtual image and the actual image, on the see-through display device 21.

Figure 5B:
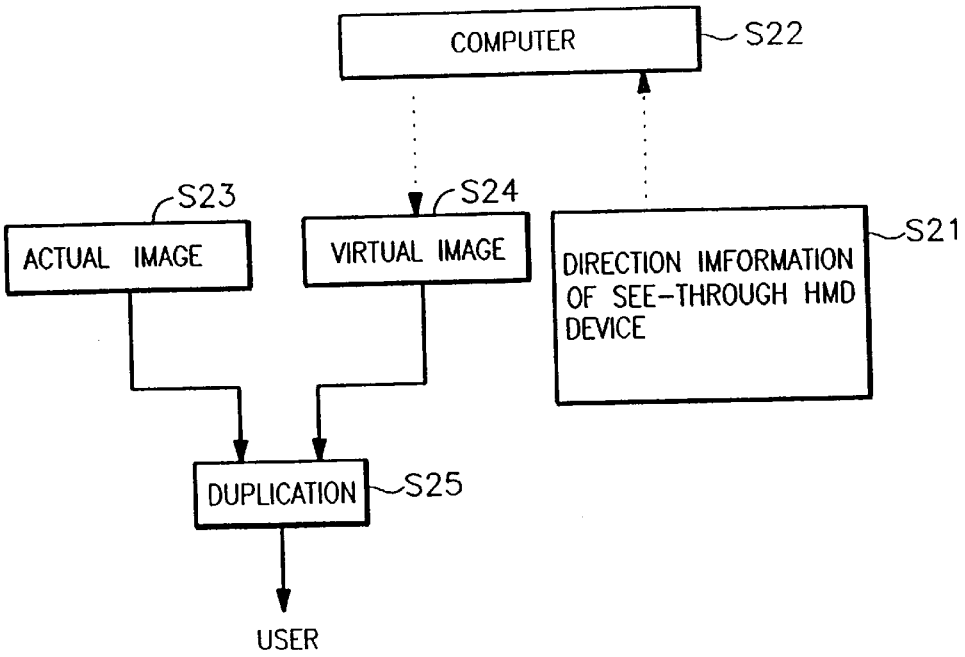
FIG. 5B is a block diagram illustrating a function of the device of FIG. 5A according to the present invention.

FIG. 5B is a block diagram illustrating a function of the device of FIG. 5A according to the present invention. As shown therein, in the see-through HMD device 20, when the see-through HMD device 20 outputs a seeing direction information of the fire fighter in a step S21, the computed receives the seeing direction information in a step S22 and generates a virtual image in a step S24, and the externally inputted actual image (in a step S23) and the virtual image are duplicated in a step S25, and then is displayed on the see-through HMD device 20.

As described above, even when there is not nay information concerning the structure of a building when a fire takes places therein, it is possible to conduct a fire fighting operation using an additional information which is provided from the device according to the present invention, whereby it is possible to more quickly and effectively perform a fire fighting operation.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. A system for supporting a fire fighting for a building, comprising:

a tracker for extracting a moving direction and speed of a fire fighter in a building;

a see-through type head-mounted display (HMD) device for extracting a seeing direction of the fire fighter and providing a current position information of the fire fighter including a graphic and text information to the fire fighter;

an externally connected computer (personal computer) for storing an information database corresponding to a structure of a building and information related thereto, tracing a position of the fire fighter in the building based on the moving direction of the fire fighter extracted by the tracker and the information database, judging an additional information with respect to a structure of the interior of the building and the structure which are seen by the fire fighter based on the seeing direction information of the fire fighter extracted by the see-through HMD device and the information database, and transmitting the same to the see-through HMD device; and a wireless data transmitting and receiving apparatus for communicating between the tracker, the see-through HMD device and the externally connected computer.

2. The system of claim 1, wherein said externally connected computer converts a position information of a fire fighter traced by the tracker and a seeing direction information of the fire fighter extracted by the see-through HMD device into a graphic coordinate, models the interior of the building to a three-dimensional feature using the coordinate, and outputs the thusly modelled data to the see-through HMD device using the wireless data transmitting and receiving apparatus.

3. The system of claim 1, wherein said tracker is a gyroscope which is capable of detecting a moving speed and direction of an object.

4. The system of claim 1, wherein said tracker and see-through HMD device is carried by a fire fighter.

5. The system of claim 1, wherein said wireless data transmitting and receiving apparatus is carried by a fire fighter or is included into the externally connected computer.

6. A fire fighting method using a system for supporting a fire fighting operation for a building wherein there are provided a portable device including a transmission and receiving apparatus, a graphic display device, and a tracker device for measuring a current position of a fire fighter, generating a graphic information corresponding to the current position of a fire fighter in the building and displaying the same to the fire fighter, and an externally connected computer for storing an information database corresponding to a structure of the building and information related thereto, judging a position of the fire fighter based on the position information received from the portable device and transmitting the same to the portable device including the graphic information and text information, comprising the steps of:

a first step for matching an initial start position of a fire fighter with an information of an information database using the portable apparatus before a fire fighter enters the building;

a second step in which the portable apparatus recognizes a moving direction and speed of the fire fighter and transmits the thusly recognized information to the externally connected computer in real time when the fire fighter moves;

a third step in which traces a position of the fire fighter in the building using the moving speed and direction data and the information database transmitted from the portable apparatus;

a fourth step in which the externally connected computer transmits the position information traced in the third step to the portable apparatus and the graphic information and text information are transmitted based on the information database; and a fifth step in which the fire fighter recognizes the position of himself/herself in the building based on the information of the portable apparatus.

7. The method of claim 6, wherein in said third step, since an error occurs while the externally connected computer traces the position of the fire fighter, a synchronization step is performed in order to match the current position value with the previous information value of the building stored in the information database when the fire fighter arrives at a predetermined position of the building, in order to reduce the error.

8. The method of claim 7, wherein in said synchronizing step, the portable apparatus carried by the fire fighter is turned off, and the tracker is turned on when the current position of the fire fighter himself is matched with the graphic information displayed on the graphic display apparatus by moving himself until the graphic information displayed on the graphic display apparatus is matched with the current position of himself.

* * * * *